United States Patent [19]

Wilkinson

[11] Patent Number: 4,542,719

[45] Date of Patent: Sep. 24, 1985

[54] ENGINE COOLING SYSTEM

[75] Inventor: Ronald E. Wilkinson, Mobile, Ala.

[73] Assignee: Teledyne Industries, Inc., Los Angeles, Calif.

[21] Appl. No.: 634,207

[22] Filed: Jul. 25, 1984

[51] Int. Cl.[4] ..... F01P 3/02

[52] U.S. Cl. ..... 123/41.35; 123/41.72; 123/41.82 R

[58] Field of Search ..... 123/41.72, 41.74, 41.76, 123/41.77, 41.82 R, 41.82 A, 41.35

[56] References Cited

U.S. PATENT DOCUMENTS 4,284,037 8/1981 Kasting et al. ..... 123/41.72

4,377,967 3/1983 Pelizzoni ..... 123/41.35

*Primary Examiner*—William A. Cuchlinski, Jr.

*Attorney, Agent, or Firm*—Gifford, VanOphem, Sheridan, Sprinkle & Nabozny

[57] ABSTRACT

The present invention provides an improved cooling system for a reciprocating piston engine. The engine is of the type having at least one cylinder and a piston movable between a top dead and bottom dead center. The cooling system comprises a housing or coolant jacket which encircles the outer end of the cylinder and extends towards the inner end of the cylinder. The coolant jacket, however, terminates short of the inner end of the piston when the piston is at its top dead position. A fluid passageway is formed through the housing and has both an inlet and outlet. Liquid coolant is supplied under pressure to the inlet port on the housing. The coolant flows through the lower section of the water jacket surrounding the piston area thus achieving uniform adequate cooling of both the combustion chamber and piston. In addition, an oil nozzle mounted within the engine crankcase directs a jet of oil onto the inner surface of the piston dome for further cooling of piston and subsequently supplements cooling of the cylinder barrel and head. The oil jet is the primary cooling mechanism for the section of the barrel not enclosed by the water jacket.

2 Claims, 4 Drawing Figures

ENGINE COOLING SYSTEM

BACKGROUND OF THE INVENTION

I. Field of the Invention

The present invention relates to an engine cooling system for a reciprocating piston engine.

II. Description of the Prior Art

There are many types of previously known reciprocating piston engines of the type having a cylinder with an inner and outer end. A piston is mounted within the interior of the cylinder and translates between a top dead and a bottom dead center position. In the top dead center position, the top or outer end of the piston is closely adjacent the outer end of the cylinder thus forming a relatively small combustion chamber between the top of the piston and top of the cylinder. Conversely, in its bottom dead center position, the top of the piston is spaced away from the top of the cylinder.

As is well known in the art, when the piston is at its top dead center position the piston compresses a fuel-/air mixture in the combustion chamber which is subsequently ignited by any conventional ignition means. The expansion of the gases resulting from this ignition forces the piston towards its bottom dead center position. In a two-stroke engine, the fuel/air mixture is ignited each time the piston is at or adjacent its top dead center position while, conversely, in a four-stroke engine the fuel/air mixture is ignited every other time the piston is at or adjacent its top dead center position.

The ignition of the fuel/air mixture within the combustion chamber in these previously known engines creates a high heat load which is transmitted not only to the cylinder but also to the piston. This heat must be dissipated or removed from both the piston and the cylinder in order to prevent thermal damage to the cylinder and/or piston which would otherwise damage the engine.

There are two different types of previously known systems for cooling both the engine cylinder and the piston, i.e., an air cooled system and a liquid cooled system. In the air cooled system, a plurality of heat conductive fins are secured to and extend outwardly from the cylinder. These fins form a heat sink which transfers the heat from the cylinder and piston to the fins and ultimately to airflow passing through the fins.

While these previously known air-cooled engines are suitable for many applications, in many applications there is insufficient airflow past the cooling fins to obtain the desired heat dissipation. Furthermore, these previously known cooling fins are heavy and bulky in construction thus rendering them unsuitable for weight critical applications, such as aircraft engines, where the weight of the cooling system is of critical importance.

In addition to a multi-cylinder air-cooled engine is not an efficient heat transfer device as compared to a well-designed finned heat exchanger and typically requires substantially higher cooling air flow rates as compared to a radiator for an equivalent liquid cooled engine, thus representing a drag penalty for aircraft applications. Whereas, it is usually difficult to achieve a uniform distribution of cooling airflow over a multi-cylinder air-cooled engine, a liquid-cooled engine eliminates the airflow distribution problem, hence improving uniformity of cylinder-to-cylinder cooling, and further contributing to a low drag approach.

Also, typical metal temperature profiles in an air-cooled cylinder are not uniform due to the variation of the cooling airflow field around the cylinder.

As a result, combustion chamber metal temperatures may vary considerably, and the temperature profiles in the area of the cylinder barrel are uneven resulting in ovalization of the barrel during engine operation and requiring large piston to cylinder running clearances.

In the previously known liquid-cooled engines, a housing or coolant jacket encases the outer end of the cylinder and extends along the sides of the cylinder to a position below the inner end of the piston when the piston is at its top dead center position. A coolant, such as water, glycol, or the like is pumped through the cooling jacket so the heat from the cylinder and piston are transferred to the coolant and disipated elsewhere by a heat exchanger or other heat disipating means. These previously known cooling systems, while effective in operation, are relatively heavy in construction since the cooling jacket extends downwardly along the sides of the cylinder and below the inner end of the piston when the piston is at its top dead center position and often times extend along the entire length of the cylinder. On multi cylinder liquid-cooled engines, the water jacket normally encases an entire cylinder bank. As such, these previously known cooling systems are undesirable for weight critical applications, such as aircraft engines.

SUMMARY OF THE PRESENT INVENTION

The present invention provides a cooling system for a reciprocating piston engine which overcomes the above-mentioned disadvantages of the previously known devices.

In brief, the cooling system of the present invention comprises a housing or coolant jacket which encircles the outer end of the cylinder in the area of the combustion chamber and extends downwardly along a portion of the cylinder length. Unlike the previously known devices, however, the coolant jacket terminates a position short of the inner end of the piston when the piston is at its top dead center position, thus leaving the lower length of the glider barrel free of the coolant jacket thereby resulting in a lightweight but effective, cooling system.

A coolant passageway having an inlet and outlet is formed within and through the housing.

A pump supplies the coolant under pressure to the inlet port, through the passageways where heat is transferred from the combustion chamber and exhaust port area to the coolant, and through the outlet port where the coolant is directed to a heat exchanger where the heat load is dissipated by conventional means.

As an integral feature of the invention the lower portion of the cylinder barrel not enclosed by the coolant jacket is cooled by the spray of an oil nozzle directed at the piston dome. An oil nozzle is mounted within the engine crankcase such that a jet of oil is directed onto the inner surface of the piston dome. This oil jet is the primary cooling mechanism for the lower barrel section and supplements cooling of the piston. During operation of the engine, engine oil is supplied by an oil pump under pressure to the oil nozzle. Heat from the cylinder wall and piston is transferred to the oil and ultimately to a heat exchanger where the heat load is dissipated by conventional means.

The present invention is thus advantageous in that the coolant housing or jacket extends only a relatively short distance along the cylinder thus minimizing the weight of the jacket.

In practice, this cooling jacket concept in combination with the oil-cooled barrel and piston has proven to be an effective means of controlling engine heat rejection. The concept has been proven to be lighter weight than an equivalent air-cooled cylinder with improved uniformity of cooling in both the combustion chamber and cylinder barrel. Uniformity of temperature profiles around the circumference and along the length of the lower cylinder barrel is significantly improved as compared to an equivalent air-cooled cylinder. Furthermore, the invention allows reduced piston-to-cylinder clearances and improves component life due to improved uniformity of cooling as compared to an equivalent air-cooled concept.

BRIEF DESCRIPTION OF THE DRAWING

A better understanding of the present invention will be had upon reference of the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
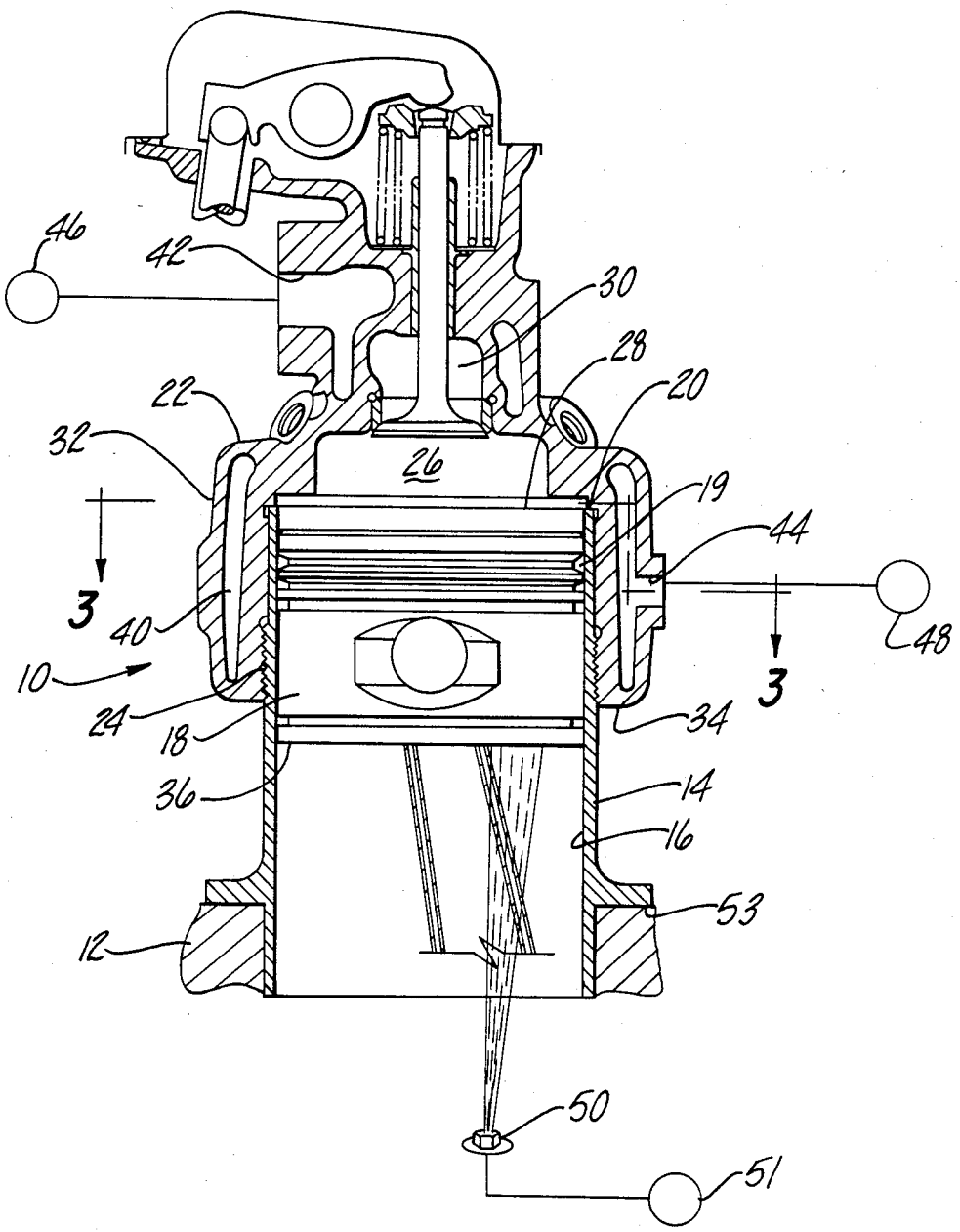
FIG. 1 is a longitudinal sectional view illustrating a preferred embodiment of the present invention and with the piston at its top dead cente position.
Figure 3:
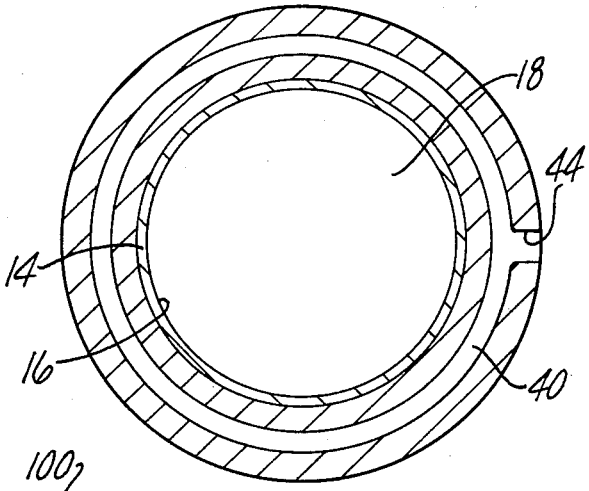
FIG. 3 is a sectional view taken substantially along line 3—3 in FIG. 1.

With reference first to FIG. 1, a portion of a reciprocating piston internal combustion engine 10 is thereshown having an engine crankcase 12. At least one engine cylinder 14 is secured to and extends outwardly from the engine crankcase 12. As best shown in FIGS. 1 and 3, the cylinder 14 is generally tubular and cylindrical in shape thus having an inter-cylindrical wall 16 and its inner end 53 attached to the crankcase 12.

Figure 2:
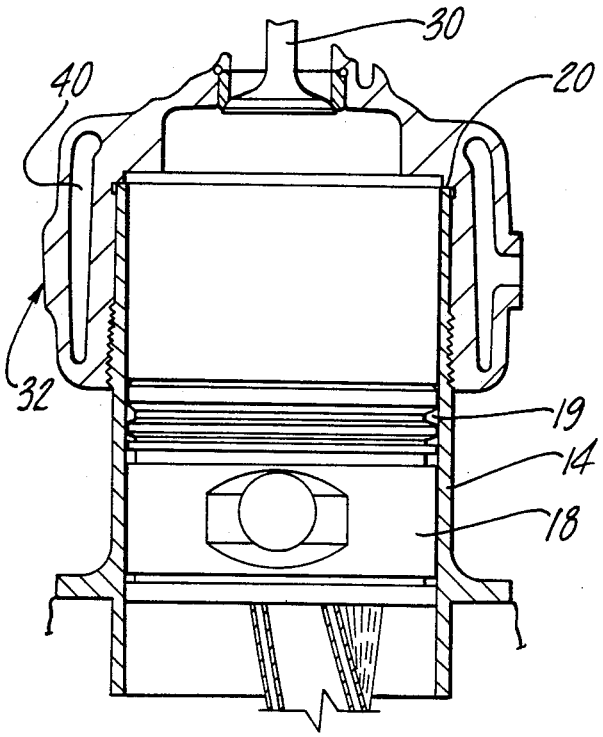
FIG. 2 is a fragmentary view similar to FIG. 1 but illustrating the piston at its bottom dead center position.

With reference now to FIGS. 1 and 2, a piston 18 is mounted within the cylinder 14 while piston rings 19 sealingly engage the inter-cylinder wall 16. The piston 18 is movable between a top dead position, shown in FIG. 1, in which the piston 18 is positioned adjacent the outer end 20 of the cylinder, and a bottom dead position shown in FIG. 2, in which the piston 18 is spaced from the outer end 20 of the cylinder 14.

With reference now particularly to FIG. 1, a cylinder head 22 is secured to the cylinder 14 by any conventional means, such as a threaded engagement 24. The cylinder head extends across and covers the open outer end 20 of the cylinder 14 thus forming a combustion chamber 26 between the top or outer most end 28 of the piston 18 when the piston 18 is at its top dead center position (FIG. 1). Conventional valve means 30 are mounted within the cylinder head 22 to introduce the fuel/air mixture into the combustion chamber 26 as well as to exhaust the combustion products from the combustion chamber 26 after ignition.

The engine thus far described is of conventional construction. Unlike the previously known engines, however, the cylinder head 22 includes a portion 32 which extends downwardly along the outside of the cylinder 14. The inner end 34 of this cylinder head portion 32 terminates short of the inner end 36 of the piston 18 when the piston 18 is at its top dead center position (FIG. 1).

Referring now to FIGS. 1 and 2, a passageway 40 having an inlet 42 (FIG. 1) and an outlet 44 is formed through both the cylinder head 22 and the downwardly extending cylinder head portion 32. A pump 46 is fluidly connected to the inlet 42 by conventional means so that, upon activation of the pump 46, a liquid coolant flows into the inlet 42, through the passageway 40 and out through the outlet 44 to a heat dissipating means 48, such as a radiator. Thus, in operation, heat from cylinder head 22, outer end of cylinder 14 and piston 18 is transferred by thermal conduction to the coolant passing through the passageway 40. In addition, the passageway 40 encircles the valve within cylinder head 22, and provides for adequate cooling of the combustion chamber 26.

A primary advantage of the engine cooling system of the present invention, is that the cylinder head portion 34 in which the coolant passageway 40 is formed terminates short of the inner end 36 of the piston 18 when the piston 18 is at is top dead center position. It has been found to be unnecessary to extend the coolant passageway 40 along the entire length of the cylinder 14 or even along the entire length of the piston 18 when at its top dead center position and yet obtain adequate cooling of the engine cylinder 14 and piston 18. Consequently the present invention provides a liquid cooling system for an internal combustion engine which is effective in operation and yet lightweight in construction. The present invention is particularly well suited for weight critical applications, such as aircraft engines.

With reference now to FIG. 1, in the preferred form of the invention, an oil spray jet 50 is secured to the engine crankcase 12 beneath the cylinder 14. The spray jet 50 is connected to the oil lubrication system 51 and oriented so that its output 52 impinges upon the inner end 36 of the piston 18. When the oil from the jet 50 impinges upon the inner end 36 of the piston 18, heat from piston 18 is transferred to the oil. In a similar manner, heat from the lower section 53 of cylinder 14 is transferred by conduction through the piston 18 to the oil. The heated oil is collected within the lower section of the engine crank case where it is then directed to a heat exchanger for cooling. The oil jet 50 thus provides for adequate cooling of the inner cylinder section 53 which is not enclosed by coolant jacket 32 and supplements cooling of the piston 18.

Figure 4:
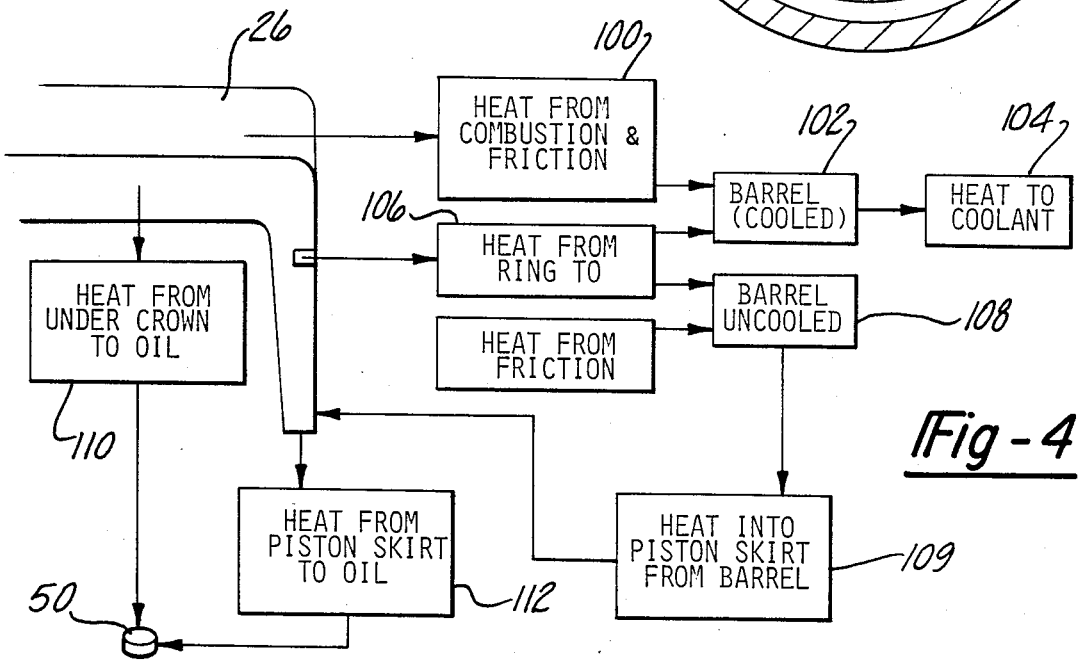
FIG. 4 is a schematic view illustrating the heat balance of the preferred embodiment of the invention.

With reference now to FIG. 4, a schematic view of the heat balance for the engine is thereshown. At box 100 the heat from the combustion chamber 26 as well as from friction is transferred to the barrel or cylinder at step 102 and then to the coolant at step 104. Conversely, only a portion of the heat from the piston ring 19 and piston friction as step 106 indicates is transferred to the coolant via box 102 while the remainder of this heat is transferred at box 108 to the barrel below the end 34 of the head portion 32.

Still referring to FIG. 4, the heat from the uncooled portion of the barrel is transferred to the piston skirt at box 109. This heat as well as the heat from beneath the piston crown is removed or cooled at boxes 110 and 112 by the oil from the oil jet 50.

From the foregoing, it can be seen that the present invention provides a liquid cooling system for a reciprocating piston internal combustion engine which is effective and lightweight in construction and thus particularly suitable for weight critical applications.

Having described my invention, however, many modifications thereto will become apparent to those skilled in the art to which it pertains without deviation from the spirit of the invention as defined by the scope of the appended claims.

I claim:

1. A reciprocating internal combustion engine comprising:

at least one elongated tubular and cylindrical cylinder, said cylinder being open at each end, a crank case, means for mounting an inner end of said at least one cylinder to said crank case, a piston reciprocally slidably mounted in each of said at least one cylinder and having a portion contacting said cylinder at an inner end and an outer end of said piston, said piston being movable between an inner position and an outer position, a jacket secured to and closing said outer end of said piston, said jacket having an inner end which is passed axially outwardly from the inner piston contacting portion when said piston is in said outer position, a coolant passage formed in said jacket and means for passing a liquid coolant through said passage, means for cooling said cylinder between said jacket and said crankcase comprising nozzle means mounted in said crank case and means for supplying pressurized coolant to said nozzle means so that said nozzle means spray coolant on an underside of said piston, said underside of said piston being open to the lower end of said cylinder.

2. The invention as defined in claim 1 wherein said engine includes valve means at the outer end of said cylinder, and wherein said passageway encircles said valve means.

* * * * *

UNITED STATES PATENT AND TRADEMARK OFFICE

CERTIFICATE OF CORRECTION

PATENT NO. : 4,542,719

DATED : September 24, 1985

INVENTOR(S) : Ronald E. Wilkinson

It is certified that error appears in the above-identified patent and that said Letters Patent are hereby corrected as shown below:

Col. 6, line 4, delete "piston" and insert thereinstead --cylinder--,

Signed and Sealed this

Twenty-fourth Day of March, 1987

*Attest:*

DONALD J. QUIGG

*Attesting Officer*

*Commissioner of Patents and Trademarks*